US009205538B2

(12) United States Patent
Yang

(10) Patent No.: US 9,205,538 B2
(45) Date of Patent: Dec. 8, 2015

(54) RATCHET WRENCH HAVING A REPLACEABLE TOOL HEAD

(71) Applicant: Wen-Hung Yang, Changhua (TW)

(72) Inventor: Wen-Hung Yang, Changhua (TW)

( * ) Notice: Subject to any disclaimer, the term of this patent is extended or adjusted under 35 U.S.C. 154(b) by 262 days.

(21) Appl. No.: 13/953,308

(22) Filed: Jul. 29, 2013

(65) Prior Publication Data

US 2014/0157959 A1 Jun. 12, 2014

(30) Foreign Application Priority Data

Dec. 11, 2012 (TW) ..... 101223987 U

(51) Int. Cl.
*B25B 13/46* (2006.01)

(52) U.S. Cl.
CPC ..... *B25B 13/463* (2013.01); *B25B 13/461* (2013.01)

(58) Field of Classification Search
CPC .... B25B 13/46; B25B 13/463; B25B 13/461; B25B 23/0007; B25B 23/0021
USPC ..... 81/60–63.2
See application file for complete search history.

(56) References Cited

U.S. PATENT DOCUMENTS

| | | | | |
|---|---|---|---|---|
| 455,133 | A * | 6/1891 | Thring | 81/62 |
| 837,537 | A * | 12/1906 | Beyer | 81/62 |
| 2,757,564 | A * | 8/1956 | Reaves | 81/61 |
| 4,592,255 | A * | 6/1986 | Mayer | 81/63 |
| 6,516,689 | B1 * | 2/2003 | Bates | 81/60 |
| 8,943,929 | B2 * | 2/2015 | Ou et al. | 81/60 |
| 2004/0134313 | A1 * | 7/2004 | Liu | 81/63.2 |

* cited by examiner

*Primary Examiner* — Hadi Shakeri
(74) *Attorney, Agent, or Firm* — Alston & Bird LLP

(57) ABSTRACT

A ratchet wrench includes: a main body having a first accommodating space; a tool head disposed removably within the first accommodating space and having an annular groove formed in an annular peripheral surface thereof, and a ratchet tooth portion; a direction control unit including a pawl block, the pawl block having a middle portion connected pivotally to the main body, and two pawl tooth portions flanking the middle portion; and a covering unit including a mounting plate, and an insert member disposed movably on the mounting plate and biased to engage the annular groove.

3 Claims, 12 Drawing Sheets

RATCHET WRENCH HAVING A REPLACEABLE TOOL HEAD

CROSS-REFERENCE TO RELATED APPLICATION

This application claims priority of Taiwanese Application No. 101223987, filed on Dec. 11, 2012.

BACKGROUND OF THE INVENTION

1. Field of the Invention

This invention relates to a ratchet wrench, and more particularly to a ratchet wrench including a tool head that is easy to replace.

2. Description of the Related Art

A conventional ratchet wrench includes a main body having a first accommodating space and a second accommodating space, a tool head having upper and lower ratchet tooth portions and an annular groove spacing the upper and lower ratchet tooth portions, and a unitary pawl block having an insert member disposed at a middle portion thereof and biased to engage the annular groove in the tool head, and two pawl tooth portions flanking the insert member. To replace the tool head, the insert member is pushed to separate from the tool head so as to allow the tool head to be removed from the main body. However, after the tool head is removed, the pawl block may be biased to drop from the main body through the first accommodating space. If this occurs, time required for replacing the tool head is prolonged. Furthermore, since the insert member is a part of the pawl block, and since it abuts against the tool body, the ratchet tooth portion of the tool head cannot be in intimate contact with either of the pawl tooth portions of the pawl block, thereby affecting adversely smooth rotation of the tool head.

SUMMARY OF THE INVENTION

The object of this invention is to provide a ratchet wrench including a tool head that is easy to replace and that can rotate smoothly.

According to this invention, a ratchet wrench includes: a main body having a first accommodating space; a tool head disposed removably within the first accommodating space and having an annular groove formed in an annular peripheral surface thereof, and a ratchet tooth portion; a direction control unit including a pawl block, the pawl block having a middle portion connected pivotally to the main body, and two pawl tooth portions flanking the middle portion; and a covering unit including a mounting plate, and an insert member disposed movably on the mounting plate and biased to engage the annular groove.

Since the pawl block is connected pivotally to the main body, it can be prevented from dropping from the main body during replacement of the tool head, and either of the pawl tooth portions of the pawl block can engage intimately the ratchet tooth portion of the tool head, thereby facilitating smooth rotation of the tool head.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
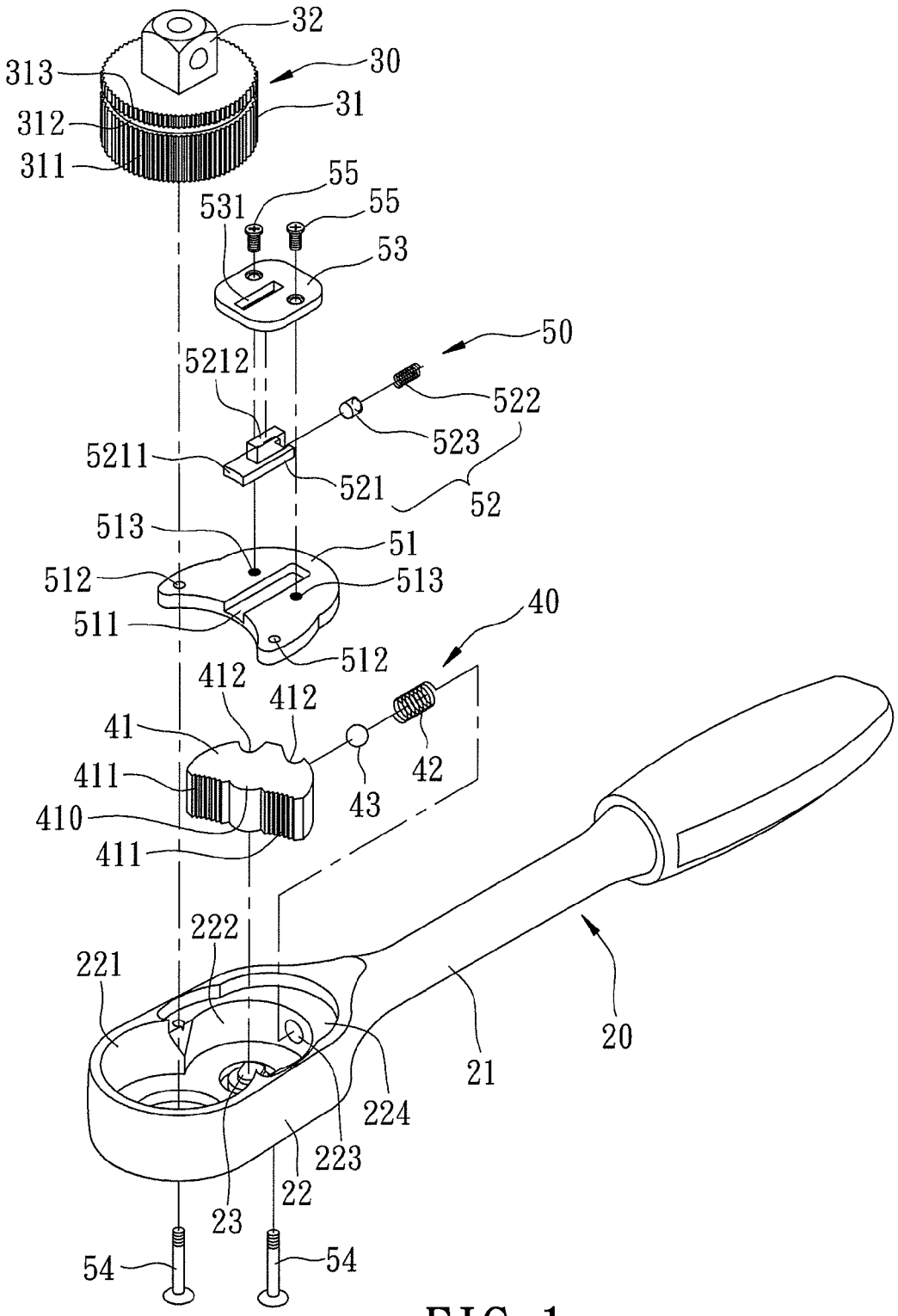
FIG. 1 is an exploded perspective view of the first preferred embodiment of a ratchet wrench according to this invention.
Figure 2:
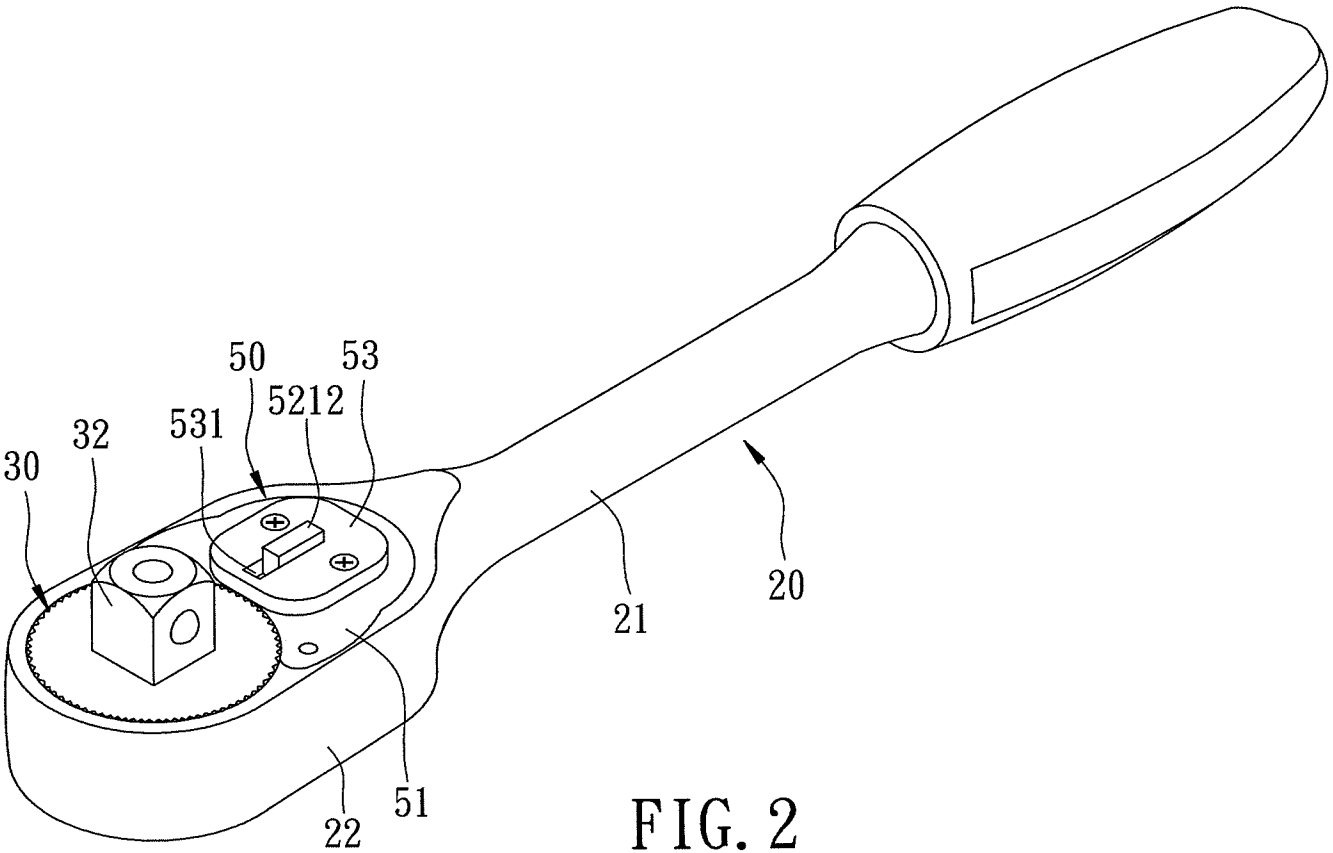
FIG. 2 is an assembled top perspective view of the first preferred embodiment.
Figure 3:
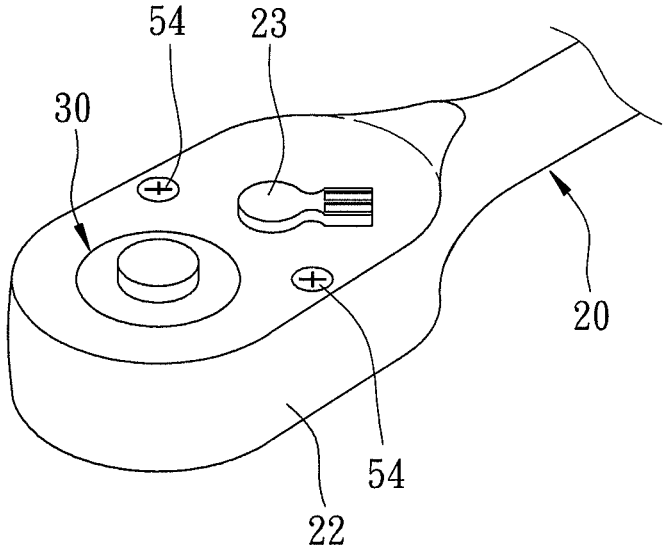
FIG. 3 is a fragmentary bottom perspective view of the first preferred embodiment.

Before the present invention is described in greater detail in connection with the preferred embodiments, it should be noted that similar elements and structures are designated by like reference numerals throughout the entire disclosure.

Referring to FIGS. 2 to 6, the first preferred embodiment of a ratchet wrench according to this invention includes a main body 20, a tool head 30, a direction control unit 40, and a covering unit 50.

Figure 4:
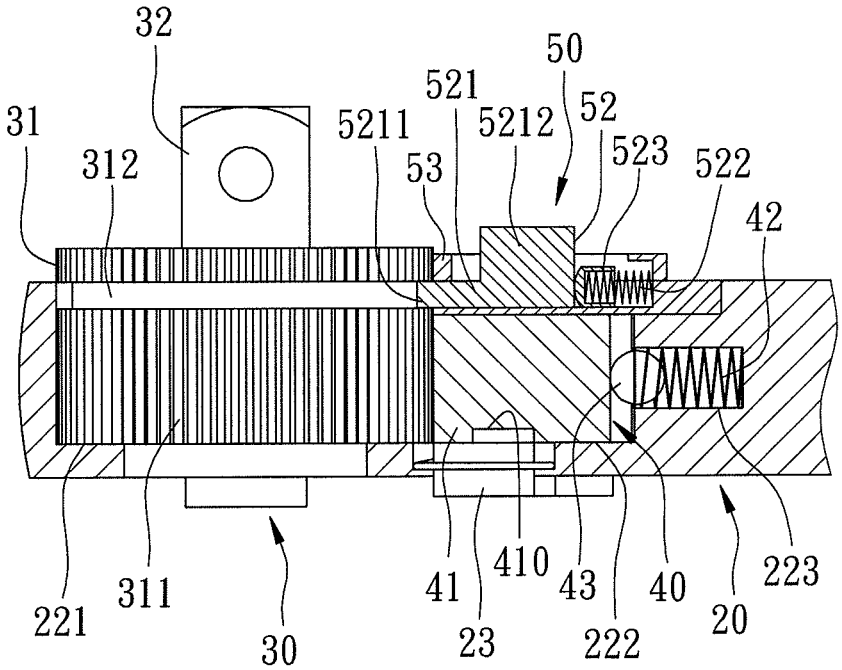
FIG. 4 is a fragmentary sectional view of the first preferred embodiment, illustrating that an insert member is inserted into an annular groove in a tool head.
Figure 5:
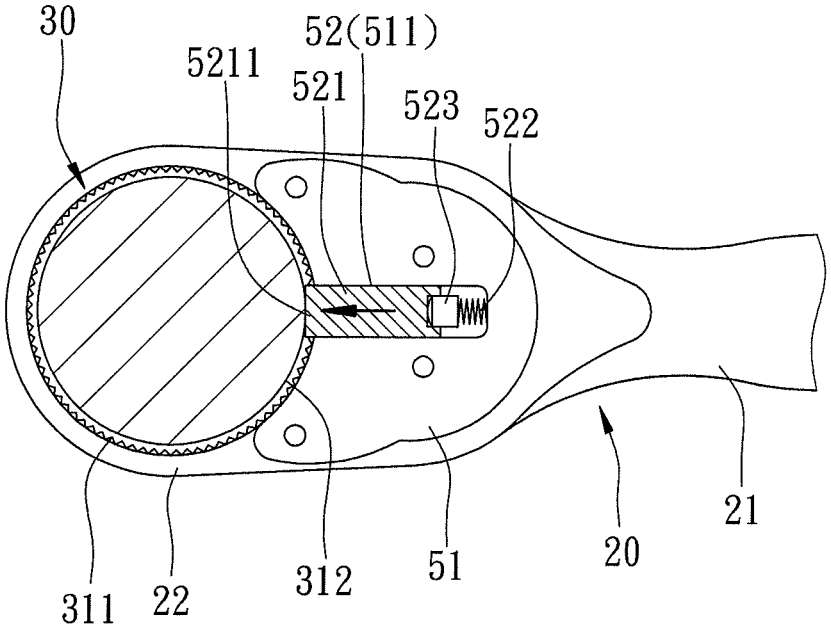
FIG. 5 is a sectional top view of the first preferred embodiment, illustrating that the insert member is inserted into the annular groove in the tool head.
Figure 6:
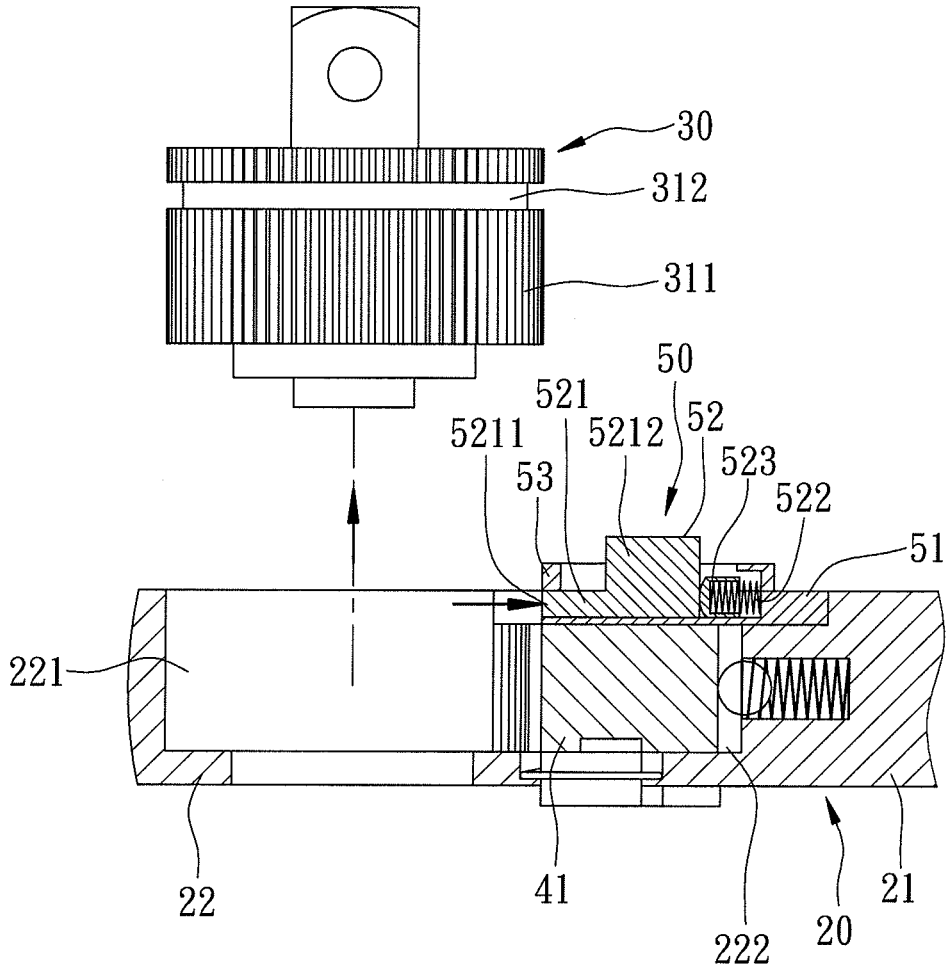
FIG. 6 is a fragmentary schematic sectional view of the first preferred embodiment, illustrating how to replace the tool head.
Figure 7:
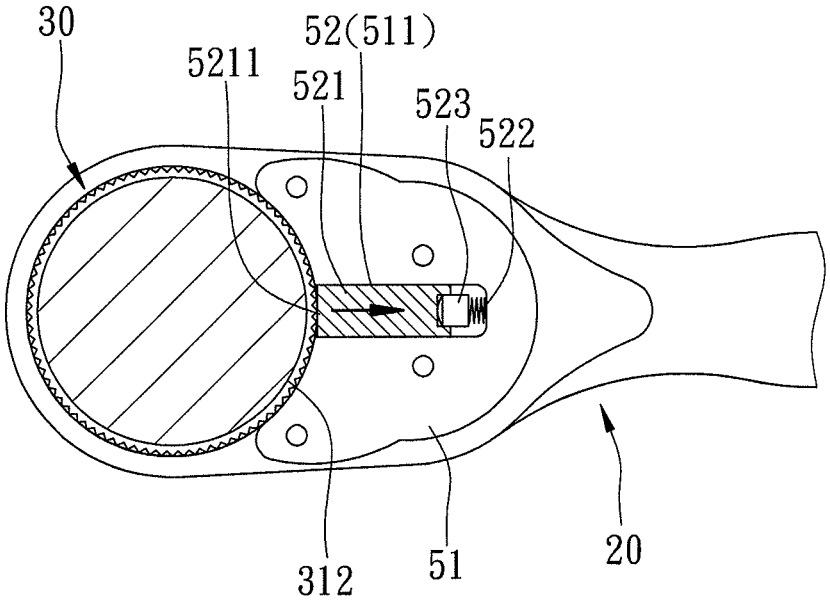
FIG. 7 is a view similar to FIG. 5 but illustrating that the insert member is removed from the annular groove in the tool head.
Figure 8:
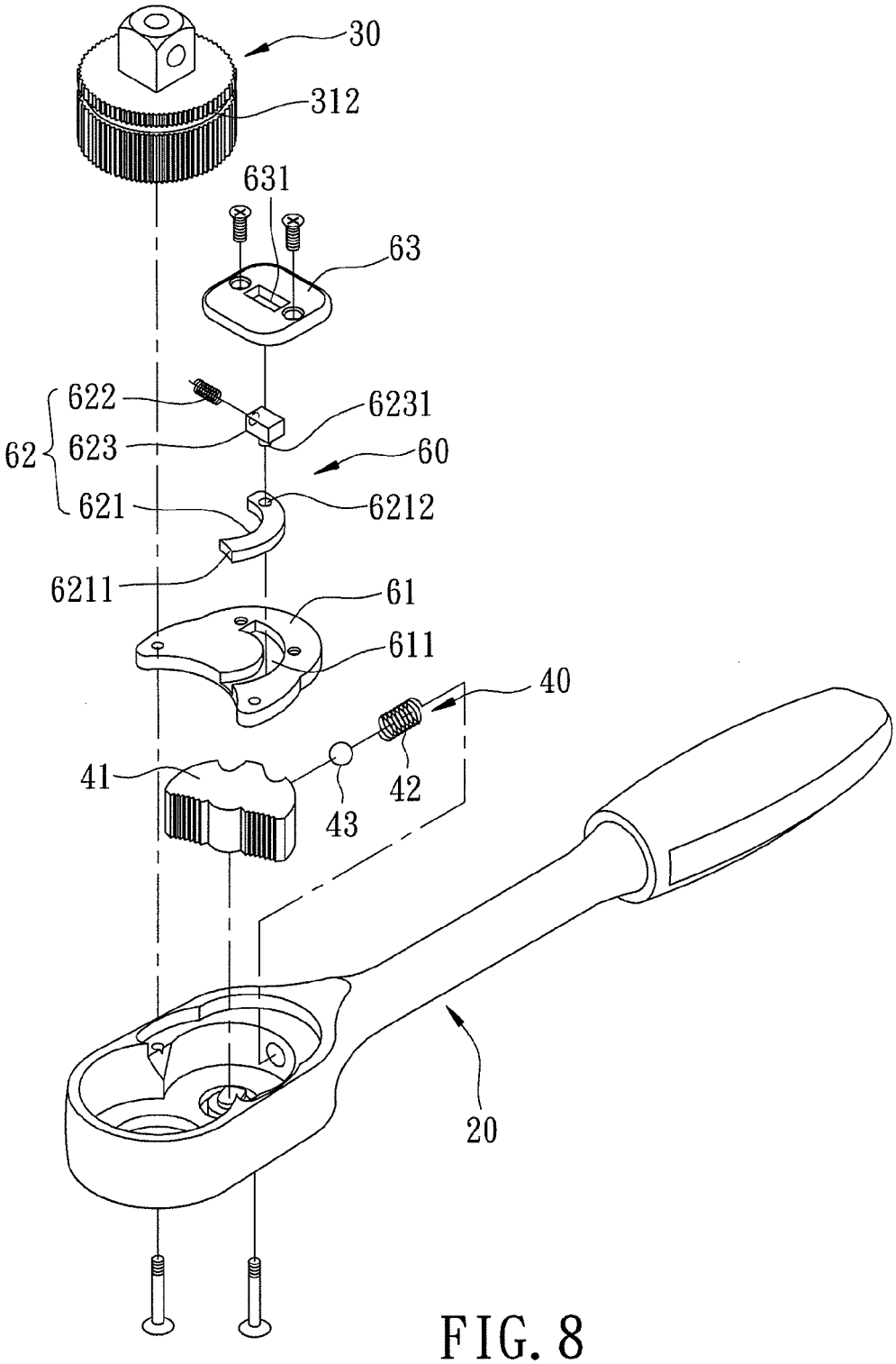
FIG. 8 is an exploded perspective view of the second preferred embodiment of a ratchet wrench according to this invention.
Figure 9:
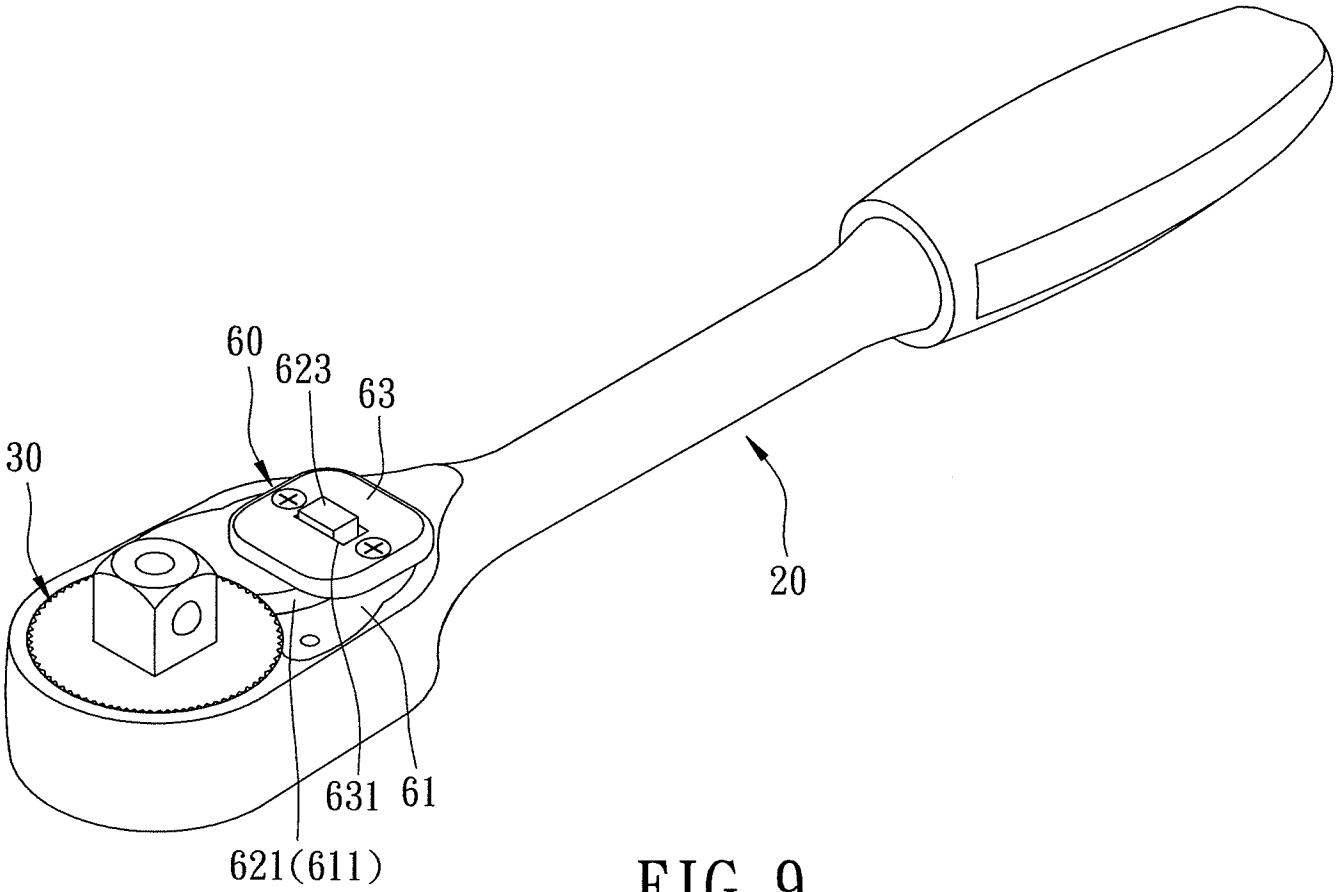
FIG. 9 is an assembled perspective view of the second preferred embodiment.
Figure 10:
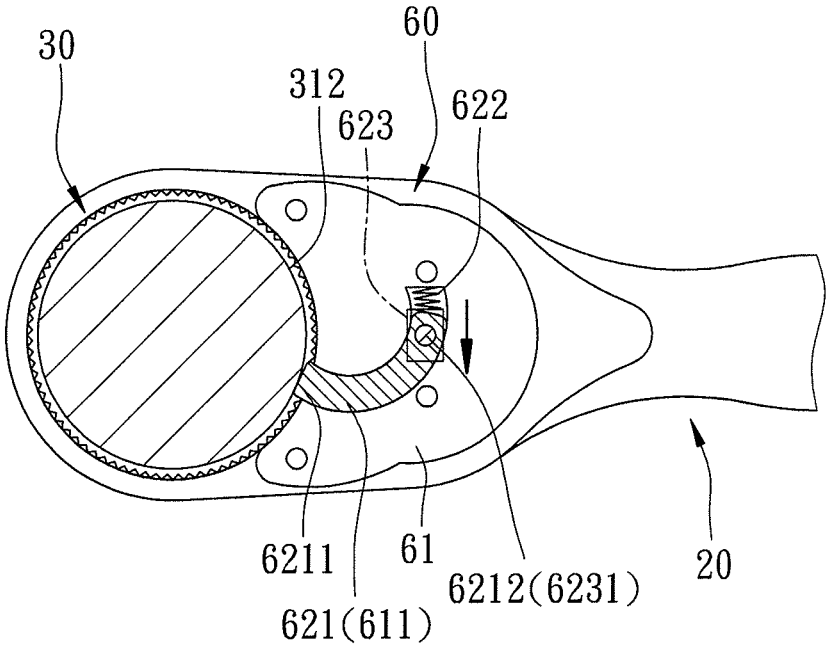
FIG. 10 is a sectional top view of the second preferred embodiment, illustrating that an insert member is inserted into an annular groove in the tool head.
Figure 11:
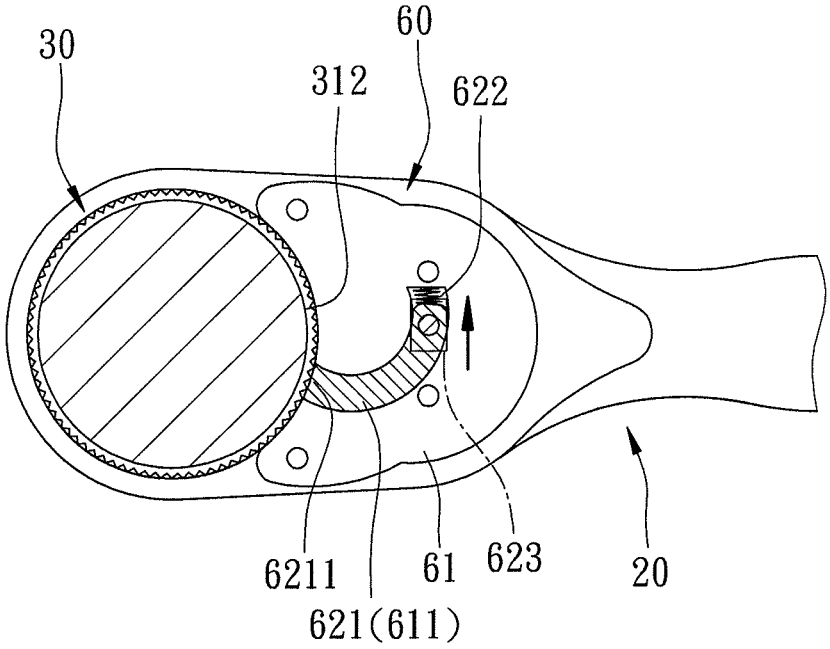
FIG. 11 is a view similar to FIG. 10 but illustrating that the insert member is removed from the annular groove in the tool head.

The main body 20 includes a rod body 21 and a head portion 22 connected to and disposed in front of the rod body 21. The head 22 has a first accommodating space 221 and a second accommodating space 222 that are in spatial communication with each other. The head portion 22 has a rear end formed with a receiving hole 223 in a wall defining the second accommodating space 222, and a stepped top surface portion defined by a shoulder 224. With particular reference to FIG. 4, the head portion 22 is provided with a rotary lever 23 extending into the second accommodating space 222.

The tool head 30 is disposed removably within the first accommodating space 221 in the main body 20, and has an annular peripheral surface, a ratchet tooth portion 311 including a plurality of ratchet teeth that are formed on the annular peripheral surface, and an annular groove 312 formed in an upper end of the annular peripheral surface. The ratchet tooth portion 311 is disposed under the annular groove 312. For convenience of manufacture, an additional ratchet tooth portion 313 is formed in the annular peripheral surface and above the annular groove 312, and includes a plurality of ratchet teeth aligned respectively with those of the ratchet tooth portion 311. As such, the annular groove 312 spaces the ratchet tooth portions 311, 313. Alternatively, the additional ratchet tooth portion 313 may be omitted from the tool head 30. The tool head 30 has a top surface formed with a driving block 32 for engaging a socket wrench (not shown).

The direction control unit 40 includes a pawl block 41 disposed within the second accommodating space 222 in the main body 20, a spring 42 disposed within the receiving hole 223, and a ball 43 disposed within the receiving hole 223. The pawl block 41 has a middle portion 410 formed with a non-circular hole 410 (see FIG. 4), and two pawl tooth portions 411 flanking the middle portion 410. An upper end of the rotary lever 23 is fitted into the non-circular hole 410 in the pawl block 41 such that, through operation of the rotary lever 23, the pawl block 41 is co-rotatable with the rotary lever 23 to engage the ratchet tooth portion 311 with a selected one of the pawl tooth portions 411, 313, so as to allow the tool head 30 to perform a unidirectional rotation within the first accommodating space 221. The pawl block 41 further has two positioning recesses 412 formed respectively in two side portions of a rear surface thereof. The ball 43 is biased by the spring 42 to engage one of the positioning recesses 412 corresponding to the selected pawl tooth portion 411 to thereby position the pawl block 41 within the second accommodating space 222.

The covering unit 50 includes a mounting plate 51 disposed above and covering the second accommodating space 222, a tool-head positioning unit 52 disposed on the mounting plate 51, a cover plate 53 disposed on the mounting plate 51 for covering the tool-head positioning unit 52, two lower bolts 54, and two upper bolts 55. The mounting plate 51 is disposed on the shoulder 224 of the main body 20, and is formed with a straight slide slot 511 having an open front end, two first threaded holes 512, and two second threaded holes 513. The lower bolts 54 extend through the main body 20 to engage the first threaded holes 512, respectively, so as to connect the mounting plate 51 fixedly to the main body 20. The tool-head positioning unit 52 includes an insert member 521, a spring 522 disposed behind the insert member 521, and a pushing block 523 disposed between the insert member 521 and the spring 522. In this embodiment, the insert member 521 is configured as a rectangular plate, is disposed movably within the straight slide slot 511, and has an insert end (i.e., front end) 5211 and a pushing portion 5212. The pushing block 523 is biased by the spring 522 to push the insert member 521 forwardly to engage the annular groove 312 in the tool head 30 with the insert end 5211, so as to prevent movement of the tool head 30 within the first accommodating space 221, while allowing for rotation of the tool head 30 within the first accommodating space 221. The cover plate 53 is disposed above and covers the slide slot 511 in the mounting plate 51. The upper bolts 55 extend through the cover plate 53 to engage respectively the second threaded holes 512 in the mounting plate 51 so as to connect the cover plate 53 fixedly to the mounting plate 51. The cover plate 53 is formed with a guide slot 531 permitting the pushing portion 5212 to extend upwardly from the cover plate 53 through the guide slot 531, so as to allow for manual operation (i.e., allow the pushing portion 5212 to be moved manually along the guide slot 531).

When replacement of the tool head 30 is desired, the pushing portion 5212 of the insert member 521 is pushed to move along the straight slide slot 511 in the mounting plate 51, so as to remove the insert end 5211 from the annular groove 312 in the tool head 30. Hence, the tool head 30 is removable from the first accommodating space 221 in the main body 20 to be replaced with a new one. When the new tool head 30 is placed into the first accommodating space 221, the pushing portion 5212 is released so that the insert member 521 is biased by the spring 522 to engage the annular groove 312. As such, the tool head 30 is easy and convenient to replace.

Since the pawl block 41 is connected pivotally to the main body 20, it can be prevented from dropping from the main body 20 during replacement of the tool head 30, and either of the pawl tooth portions 411 of the pawl block 41 can engage intimately the ratchet tooth portion 311 of the tool head 30, thereby facilitating smooth rotation of the tool head 30. Thus, the object of this invention is achieved.

FIGS. 8 to 11 show the second preferred embodiment of a ratchet wrench according to this invention, which is similar to the first preferred embodiment except for a modified covering unit 60. The modified covering unit 60 includes a mounting plate 61, a tool-head positioning unit 62, and a cover plate 63. The mounting plate 61 is formed with a curved slide slot 611. The tool-head positioning unit 62 is disposed in the curved slide slot 611, and includes an insert member 621, a spring 622, and a push block 623. The insert member 621 is configured as a curved plate, and has an insert end 6211 and a pivot hole 6212. The push block 623 is formed with a projecting post 6231 that extends rotatably into the pivot hole 6212 in the insert member 621. As such, the push block 623 is disposed pivotally on the insert member 621. The cover plate 63 is disposed above and covers the slide slot 611, and is formed with a guide slot 631 permitting the push block 623 to extend upwardly from the cover plate 63 through the guide slot 631 so as to allow for manual operation.

Figure 12:
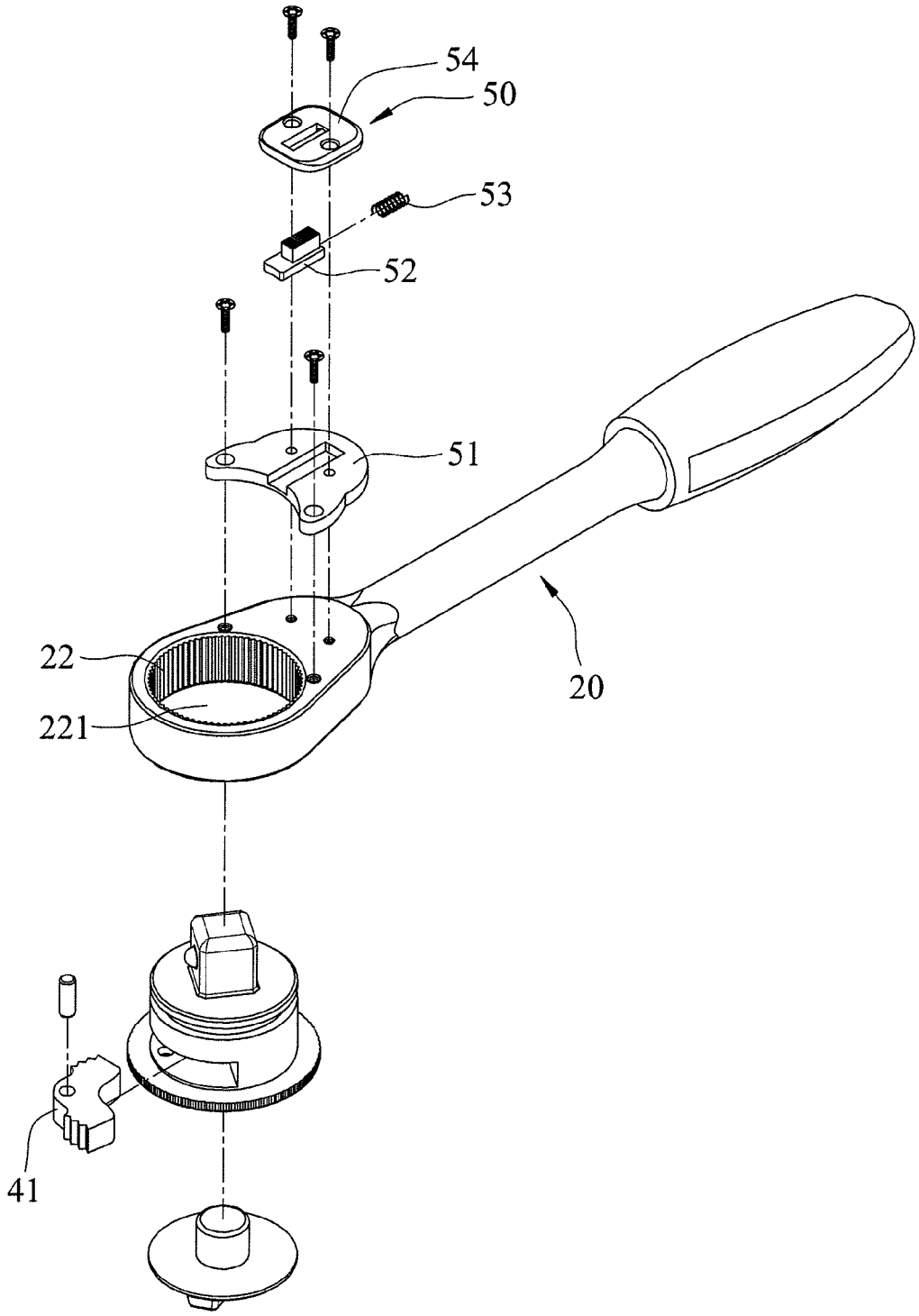
FIG. 12 is an exploded perspective view of the third preferred embodiment of a ratchet wrench according to this invention.

FIG. 12 shows the third preferred embodiment of a ratchet wrench according to this invention, which is similar to the first preferred embodiment. In this embodiment, the second accommodating space 222 (see FIG. 1) is omitted from the head portion 22 of the main body 20, and the first accommodating space 221 is cylindrical.

With this invention thus explained, it is apparent that numerous modifications and variations can be made without departing from the scope and spirit of this invention. It is therefore intended that this invention be limited only as indicated by the appended claims.

What is claimed is:

1. A ratchet wrench including:

a main body having a first accommodating space formed in a front end thereof;

a tool head disposed removably within the first accommodating space in the main body and having an annular peripheral surface, an annular groove formed in an upper end of the annular peripheral surface, and a ratchet tooth portion including a plurality of ratchet teeth that are formed on the annular peripheral surface and that are disposed under the annular groove;

a direction control unit including a pawl block having two pawl tooth portions and rotatable within the main body to engage the ratchet tooth portion with a selected one of the pawl tooth portions to allow the tool head to perform a unidirectional rotation within the first accommodating space, the pawl block further having a middle portion connected pivotally to the main body, the pawl tooth portions flanking the middle portion;

a covering unit including an insert member biased to engage the annular groove in the tool head so as to prevent movement of the tool head within the first accommodating space, while allowing for rotation of the tool head within the first accommodating space; and a mounting plate disposed on the main body, the insert member being disposed movably on the mounting plate;

wherein, the main body further has a second accommodating space in spatial communication with the first accommodating space for receiving the pawl block, the mounting plate being disposed above and covers the second accommodating space and formed with a slide slot permitting the insert member to be disposed movably therein, the covering unit further including a cover plate disposed above and covering the slide slot and formed with a guide slot through which the insert member is manually accessible, and a spring disposed in the slide slot for biasing the insert member to engage the annular groove in the tool head.

2. The ratchet wrench as claimed in claim 1, wherein the insert member is configured as a horizontal rectangular plate and has a pushing portion, the slide slot in the mounting plate being straight, the guide slot in the cover plate permitting the pushing portion of the insert member to extend upwardly from the cover plate through the guide slot so as to allow for manual operation.

3. The ratchet wrench as claimed in claim 1, wherein the slide slot in the mounting plate is curved, the insert member being configured as a curved plate, the covering unit further including a push block disposed pivotally on the insert member, the guide slot in the cover plate permitting the push block to extend upwardly from the cover plate through the guide slot so as to allow for manual operation.

* * * * *